United States Patent [19]

Appelmann

[11] 4,332,108

[45] Jun. 1, 1982

[54] COLLAPSIBLE REVOLVING DOOR

[75] Inventor: Horst Appelmann, Pickering, Canada

[73] Assignee: C. J. Rush Limited, Scarborough, Canada

[21] Appl. No.: 99,809

[22] Filed: Dec. 3, 1979

[51] Int. Cl.[3] ..... E05D 15/02

[52] U.S. Cl. ..... 49/44

[58] Field of Search ..... 49/44, 42, 141

[56] References Cited

U.S. PATENT DOCUMENTS 3,495,251 2/1970 Lowe ..... 49/44

3,736,701 6/1973 Rush et al. ..... 49/44

*Primary Examiner*—Kenneth Downey

*Attorney, Agent, or Firm*—Rogers, Bereskin & Parr

[57] ABSTRACT

A collapsible revolving door is described and includes upper and lower latching mechanisms which normally retain leaves of the door in radially disposed, angularly spaced positions but which allow the leaves to collapse flat against one another in the event that abnormal forces are applied thereto. Each latching mechanism includes one latch member for each leaf. The latch member is mounted on a pivot pin for the leaf so that the latch member will turn with the leaf from a normal radial position to a collapsed position. The latch member is retained in its normal position by spring biassed detents which will release when abnormal forces are applied to the associated leaf.

11 Claims, 5 Drawing Figures

COLLAPSIBLE REVOLVING DOOR

This invention relates to collapsible revolving doors.

Revolving doors of this kind typically comprise four transparent glass leaves which are angularly spaced about a vertical axis and which rotate together about the axis when the door is in normal use. Collapsing mechanisms are provided in association with the leaves and are designed to allow the leaves to collapse flat against one another in the event that they are subjected to abnormal forces such as would occur if a large number of people attempted to pass through the door as in a panic situation. Thus, the collapsing mechanisms provide a safety feature allowing people to pass straight through the door in the event of a fire or other emergency. The leaves can also be deliberately collapsed to allow unusually large items to be transported through the door.

U.S. Pat. Nos. 3,495,251 (Lowe) and 3,736,701 (Rush et al.) disclose examples of collapsible revolving doors of the kind referred to above.

It is well recognized that, in high traffic locations, the heat lost when a revolving door is in use is substantially less than would be lost with a conventional hinged door. In other words, revolving doors offer significant advantageous in terms of energy conservation in high traffic areas. Despite this, however, revolving doors have not found wide acceptance as entrance doors for supermarkets and other stores because of the comparatively small space available between the leaves of the door. Attempts have been made to produce large (e.g. 10 foot) diameter revolving doors having only three leaves. While these doors are satisfactory in that substantially more space is available between adjacent leaves, it has not hitherto been possible to make these doors collapsible and they have therefore been unacceptable from a safety standpoint. The reason for this is thought to be that existing collapsing mechanisms cannot accommodate the substantially higher turning moment produced when a person pushes on the leaf of a 10 foot diameter door in moving through the door, compared with a smaller door. In other words, the leaves of the door collapse too easily. At the same time, it has not been found possible to simply increase the strength of existing mechanisms.

An object of the present invention is to provide a collapisble revolving door having an improved mechanism for permitting the leaves of the door to collapse in a panic situation.

According to the invention the door includes a plurality of door leaves normally extending radially outwardly from a generally vertical axis in angularly spaced positions. The leaves are mounted in a door opening for rotation about said axis by upper and lower bearing means. The door also includes upper and lower latching mechanisms interposed between the leaves and respective bearing means and adapted to normally maintain the leaves in their radial positions, but to permit pivotal movement of each leaf about a generally vertical axis disposed adjacent its inner end, between said normal radial position and the collapsed position in the event that the leaf is subjected to abnormal forces. Each latching mechanism includes a housing coupled to the relevant one of said bearing means for rotation about the vertical axis of the door. The mechanism also includes a plurality of pins each coupling one of the leaves to the housing and mounted to turn in the housing about the pivot axis of the associated leaf. A plurality of latch members are disposed in the housing and each member is coupled at a position intermediate its ends to one of the coupling pins so that pivotal movement of the leaf between its normal radial position and its collapsed position causes concomitant pivotal movement of the associated latch between a normal position and a collapsed position. The mechanism further includes means in said housing retaining the latch members in their normal positions but adapted to permit release of any latch member in the event that abnormally high forces are applied to the associated leaf so that the leaf can move to its collapsed position.

In order that the invention may be more clearly understood, reference will now be made to the accompanying drawings which illustrate a preferred embodiment by way of example, and in which.

Figure 1:
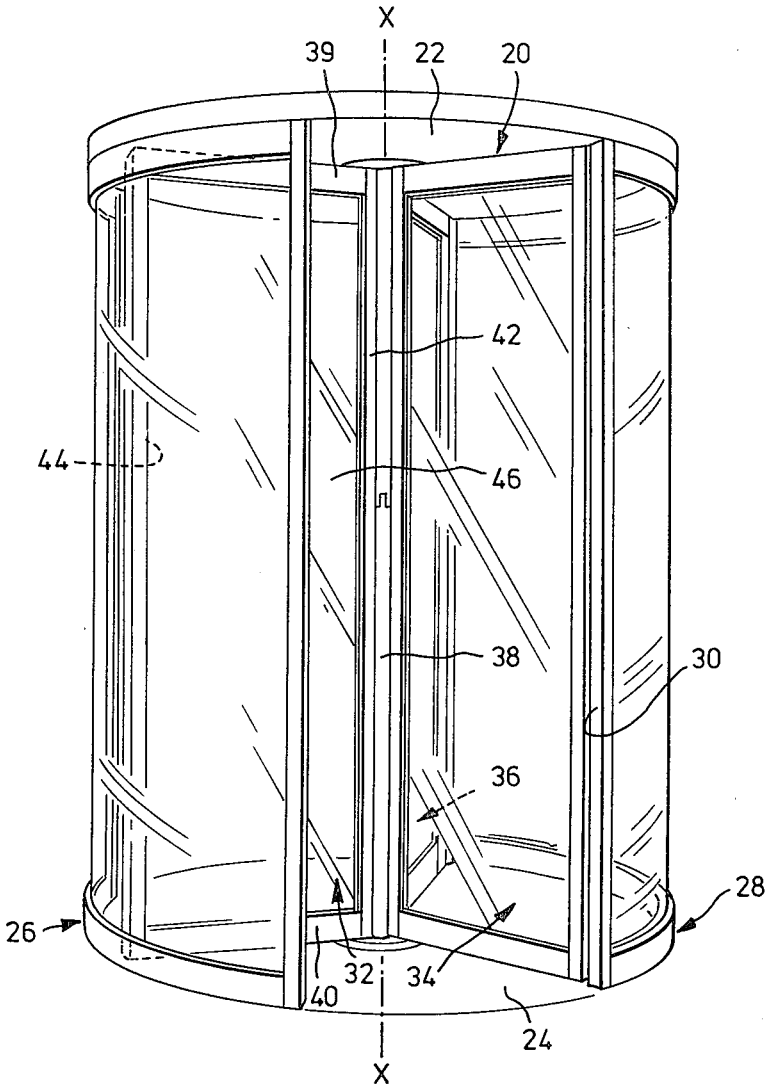
FIG. 1 is a perspective view of a revolving door according to the invention.

Referring first to FIG. 1, a revolving door according to the invention is generally indicated at 20 and is shown installed in a doorway defined by ceiling and floor surfaces 22 and 24 respectively and by curved transparent walls 26 and 28. An access opening 30 is defined between the walls 26 and 28 at one side of the door and a similar opening (not visible) is defined by the walls at the opposite side of the door. In this particular embodiment, door 20 has three transparent leaves 32, 34 and 36 which normally extend radially outwardly from a generally vertical axis in equi-angularly spaced positions. In FIG. 1, this generally vertical axis is represented at X—X and is defined by a centre shaft 38 of the door.

The door leaves 32, 34 and 36 are identical with one another. Referring to door 32 by way of example, each door has upper and lower rails 39 and 40 respectively, an inner vertical stile 42 and an outer vertical stile 44. The upper and lower rails and stiles form a frame supporting a sheet 46 of toughened glass.

Figure 2:
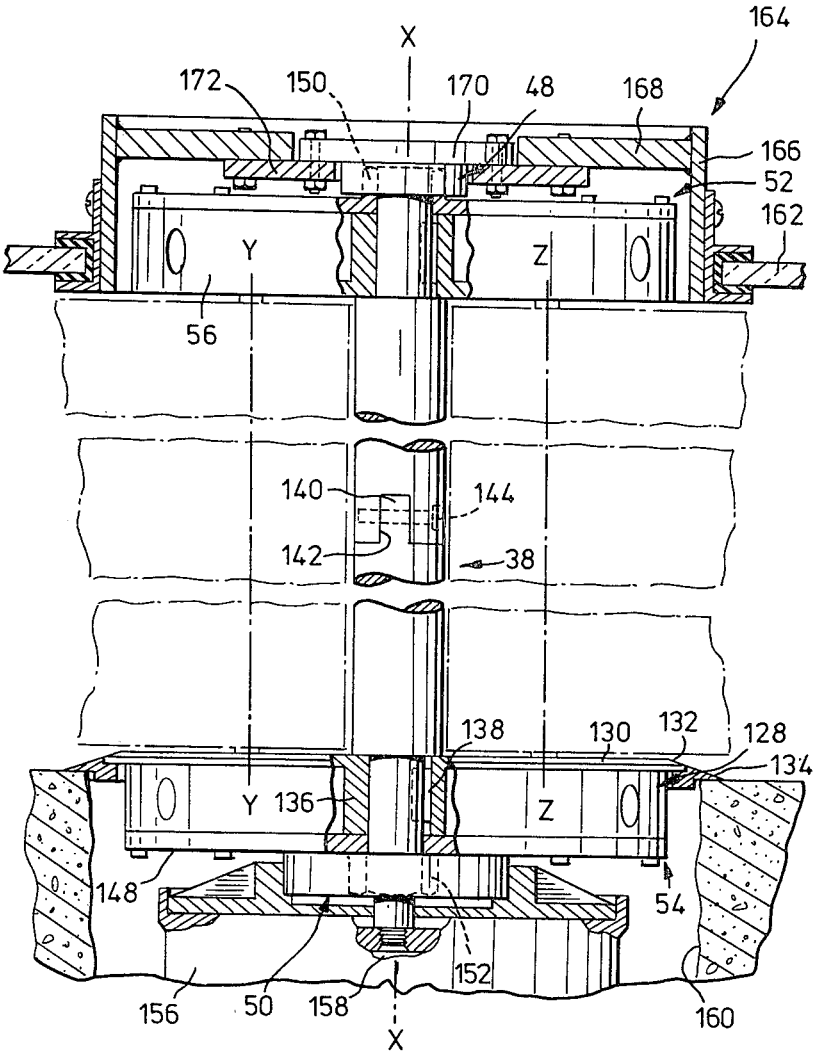
FIG. 2 is a vertical sectional view through the door of FIG. 1.
Figure 4:
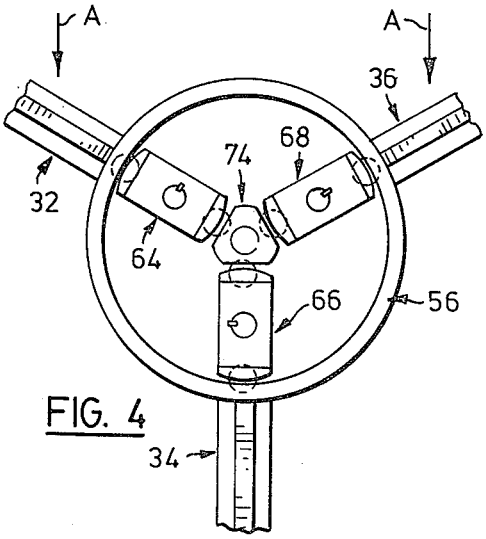
Figure 5:
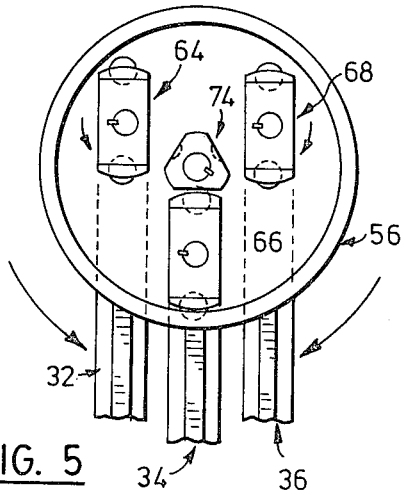

Reference will now be made to FIG. 2 which is a vertical sectional view through the door of FIG. 1 taken on a diametral plane passing through axis X—X. The door leaves themselves have not been shown in FIG. 1 but two of the leaves are indicated in ghost outline at 32 and 34 respectively. Upper and lower bearings 48 and 50 respectively are visible in FIG. 2 and support the leaves in the doorway for rotation about axis X—X. The bearings are of the form conventionally used in revolving doors; bearing 48 is a self-aligning roller bearing and bearing 50 is a taper roller thrust bearing capable of supporting the weight of the door. Upper and lower latching mechanisms 52 and 54 respectively are interposed between the door leaves and the respective bearings 48 and 50. The latching mechanisms normally maintain the leaves in the radial positions in which they are shown in FIG. 1 but permit each leaf to pivot about a generally vertical axis disposed adjacent the inner end of the leaf, between its normal radial position and a collapsed position in the event that the leaf is subjected to abnormal forces such as would occur, for example, during a panic situation. FIGS. 4 and 5 illustrate the respective positions of the leaves; in FIG. 4, the leaves are shown in their normal radial positions, while in FIG. 5 the leaves are shown collapsed flat against one another as a result of abnormally high forces applied to the outermost leaves 32 and 36 in the direction indicated by the arrows A in FIG. 4. In this particular example, leaf 34 has not moved from its normal radial position because of the directions in which the abnormal forces were applied; however, that leaf also the the facility to collapse if necessary in the same manner as the other leaves.

The pivot axes of the leaves 32 and 34 are indicated at Y—Y and Z—Z in FIG. 2 and are defined by the coupling pins which form part of the latching mechanisms as will be described later. Axis Z—Z appears closer to the central shaft 38 of the door than axis Y—Y only because of the disposition of leaf 34 with respect to the plane in which the section of FIG. 2 is taken. In fact, the pivot axes of all three doors are disposed equidistant from the central axis X—X of the door.

Figure 3:
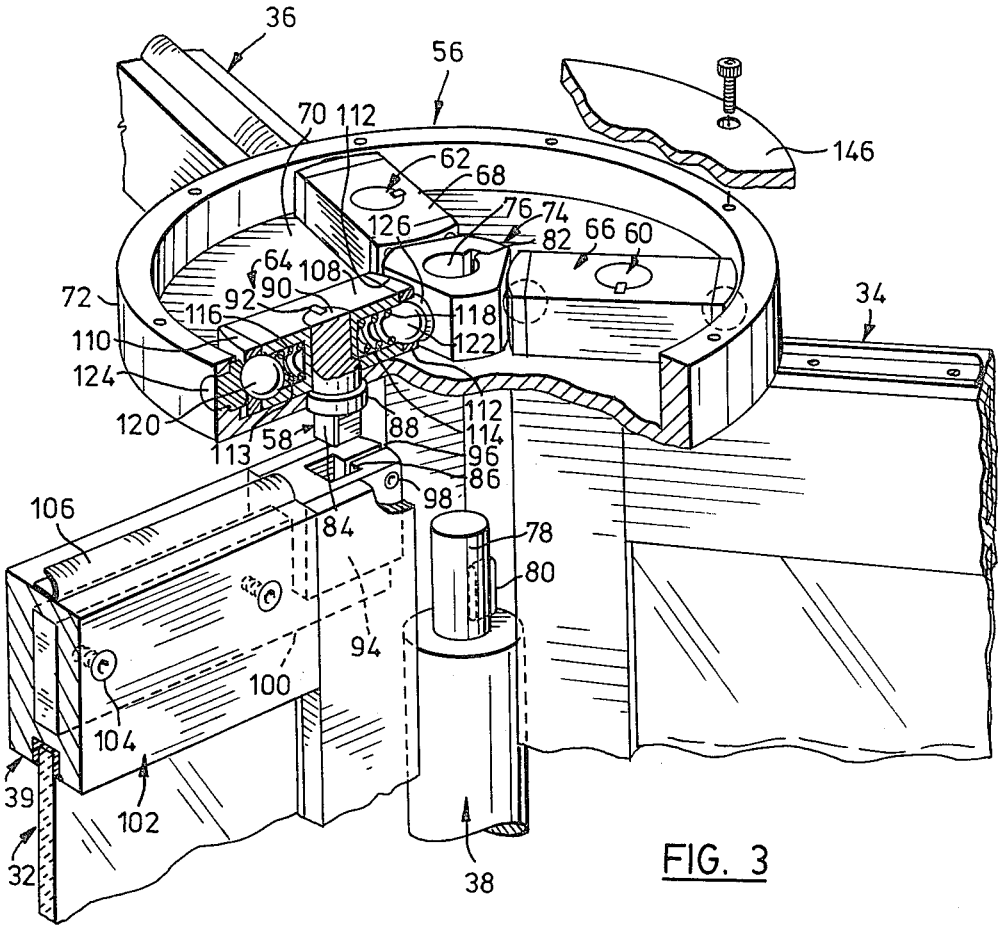
FIG. 3 is a partly exploded perspective view showing the upper latching mechanism of the door; and, FIGS. 4 and 5 are diagrammatic plan views showing the leaves of the door respectively in their normal radial positions and in their collapsed positions.

FIG. 3 shows the upper latching mechanism 52 in detail; the lower latching mechanism 54 is substantially the same and will not therefore be described. For the present, it is sufficient to note that mechanism 54 as installed is inverted compared with the mechanism 52 as shown in FIG. 3. In any event, referring to that view, mechanism 52 includes a housing 56 which is coupled to the upper bearing 48 by way of the central shaft 38 of the door so that the housing is rotatable about axis X—X. Three coupling pins 58, 60 and 62 are mounted to turn in the housing and define the pivot axes of the door leaves. Each of these pins couples one of the door leaves to housing 56 and will turn in the housing with the associated leaf. Three latch members 64, 66 and 68 are also provided in the housing and each latch member is coupled at a position intermediate its ends to one of the coupling pins so that pivotal movement of any one of the leaves 32, 34 or 36 between its normal radial position and its collapsed position will cause concomitant pivotal movement of the associated latch member. The latch members are retained in the housing in the normal positions in which they are shown in FIG. 3 but will release in the event that abnormally high forces are applied to any of the leaves to permit that leaf to move to its collapsed position. Thus, in FIG. 3, the latch members are all shown retained in their normal radial positions but in FIG. 5, the latch members 64 and 68 have been released and pivoted to positions corresponding to the collapsed positions of the associated leaves 32 and 36.

Having generally described the principal features of the latching mechanism 52, the mechanism will now be described in more detail.

Housing 56 comprises a circular base plate 70 having an upstanding annular wall 72 which extends about axis X—X. At the centre of base plate 70 is an integral collar 74 which extends upwardly from the base plate and which has a generally triangular profile as seen from above. This collar forms a reaction member for the latch members 64, 66 and 68 as will be described later. Collar 74 has a central opening 76 for receiving a portion 78 of reduced diameter at the upper end of the door shaft 38. Housing 56 is keyed to shaft 38 by a key 80 on shaft portion 78 which is received in a keyway 82 inside collar 74. The corresponding housing for the lower latching mechanism 54 is similarly keyed to shaft 38 so that the housing of the two latching mechanism will rotate together with the shaft.

Reference will now be made to coupling pin 58 as typical of the three coupling pins 58, 60 and 62. Pin 58 has a squared lower end 84 which is received in a complimentary square opening 86 in the associated door 32. Immediately above the squared end 84 is a protuberant annular collar 88 which is turnably received in a complimentary opening in the base plate 70 of housing 56. Immediately above collar 88 is a cylindrical portion 90 of the pin which projects above base plate 70 and into a complimentary bore in latch member 64. A key 92 projects from the coupling pin into a complimentary keyway inside the bore so that the coupling pin and latch member are positively coupled together.

As indicated previously, the lower squared end of coupling pin 58 is received in a complimentary squared opening 86 in door 32. Opening 86 is in fact formed in a connector block 94 which is incorporated in the upper rail 39 of door 32. Connector block 94 is formed in one end with a slot 96 which opens into the square opening 86 and the slot can be closed by a clamp screw 98 to grip onto the squared portion of coupling pin 58. Block 94 is made of steel and has welded thereto a steel arm 100 which projects outwardly of the block to in effect form the main spine of the upper door rail 39. Arm 100 is enclosed in an aluminum shoe 102 which actually supports the glass 46 of the door. Screws securing the shoe to arm 100 are visible at 104. A rubber sweep 106 extends along the top edge of the shoe for cooperation with the under surface of base plate 70 and acts as a draft excluder. The inner door stile 42 is of conventional form except in that it is recessed at its upper end to receive connector block 94. A standard sweep and bump stop (not shown) are provided at the inner edge of stile 42 for co-operation with shaft 38, again in conventional fashion.

The three latch members 64, 66 and 68 are identical and latch member 64 will now be described as representative of all three members. The latch member includes a main body portion 108 of elongate, generally rectangular shape fitted with end caps 110 and 112. The bore which receives the coupling pin 58 extends vertically through the main body portion 108 at the centre of its length. On either side of this bore are two lateral bores 113 and 114 which receive respective helical coil springs 116 and 118. The bores are blind at their inner ends but have open outer ends which receive respective detent balls 120 and 122. The springs 116 and 118 bias the balls outwardly of the main body portion of the latch member and the balls are held in place by the end caps 110 and 112. The end caps are attached to the main body portion of the latch member by screws (not shown). Each end cap has an opening of a diameter slightly smaller than the diameter of the associated ball so that the ball protrudes from the undercap.

The balls 120 and 122 co-operate with complimentary socket members 124 and 126 mounted respectively in the wall 72 of housing 56 and in the reaction member 74 at the centre of the housing. Thus, as can be seen, each socket member comprises a generally cylindrical portion received in a complimentary opening in the relevant portion of the housing, and a head having a dished outer surface which receives the associated ball. The two balls of the latch member are biassed outwardly by their associated springs into the socket members so that the balls act as spring biassed detents which resist turning of the latch member with the associated coupling pin. The latch members are disposed in co-planar relationship with the respective door leaves so that the latch members also extend radially of axis X—X when the leaves are in their normal radial positions. The spring biassed detent balls 120 and 122 tend to retain the latch members in these radial positions. However, in the event that an abnormal force is applied to any one of the leaves tending to turn the leaf about its pivot axis, that force will be transmitted to the associated latch member by way of the coupling pin (as pin 58). When the magnitude of the applied force is sufficient to overcome the biassing effect of the springs 116, 118 on the detent balls 120 and 122, the balls will move out of their associated socket members and allow the leaf to swing into its collapsed position. The detent springs will be carefully chosen so that their strength is sufficient to allow collapsing of the associated leaf only when the leaf is subjected to abnormal forces of appropriate magnitude. In other words, the springs must be sufficiently strong to prevent the leaf collapsing in normal use.

The latch members will of course allow a collapsed leaf to be returned to its normal radial position by applying sufficient force to the leaf to cause the detent balls to re-engage with the socket members.

Referring back to FIG. 2, the housing of the lower latch mechanism (corresponding to to housing 56) is indicated at 128 and is inverted compared with housing 56. Thus, the base plate of housing 128 is at the top as seen in FIG. 2. This plate is indicated at 130 and has a chamfered outer edge 132 to which a sweep ring 134 is fitted, having a correspondingly chamfered edge. The sweep ring and edge 32 co-operate to merge with the floor surface 44 of the doorway so as to prevent minimum obstruction to people using the door.

FIG. 2 illustrates the fact that the central shaft 38 of the door is keyed to housing 128 by way of the central collar or reaction member of the housing (corresponding to member 74) which is indicated at 136. A key between the member and shaft 38 is indicated at 138.

In order to facilitate installation, shaft 38 is in fact made into parts connected by a diametral tongue 140 on one part which engages in a complimentary groove 142 in the other. The two shaft halves are secured together by a bolt 144.

The fact that the upper and lower latching mechanisms are positively coupled together by way of shaft 38 has the advantage that the upper and lower coupling pins for each door leaf will always be accurately aligned with one another and the associated latch members will always release at the same time when abnormal forces are applied to the leaf. This found to be particularly advantageous in the case of large diameter doors where the leaves are large. However, within the broad scope of the invention, the latching mechanisms need not be coupled together in this way but could operate independently of one another generally in the manner disclosed in Patent No. 3,736,701.

The housing of each latching mechanism is provided with a cover plate; the cover plate for housing 56 is indicated at 146 and part of it is also shown in FIG. 3 while the corresponding plate for housing 128 is indicated at 148 in FIG. 2. The plates are secured to the associated housings by screws which pass through the plates and are threaded into openings in the outer walls of the respective housings. Each plate has a central collar which projects outwardly around the central shaft 38 of the door and on which the inner race of the associated bearing is mounted. Referring to the cover plate 146 of the upper latching mechanism, its collar is indicated at 150 and is fitted inside the inner race of bearing 48. The collar for the cover plate 148 of the lower latching mechanism is visible at 152 and is similarly received inside the inner race of bearing 50. The outer race of this bearing is secured to the top of the casing 156 of a conventional door speed control mechanism. The door shaft 38 extends downwardly through bearing 50 and has a square 158 at its lower end by which the shaft is coupled to this mechanism. The speed control mechanism, however, forms no part of the present invention and is entirely conventional and will not therefore be described in detail. This entire mechanism and the latching mechanism 54 and bearing 50 are housed within a recess 160 in the floor below the doorway. The upper latching mechanism 52 and bearing 48 are somewhat similarly located in the ceiling above the doorway. The ceiling is indicated at 162 and a casing or enclosure 164 extends upwardly above the ceiling surface. The casing has a cylindrical outer wall 166 and a top wall 168. The top wall has a central opening receiving a mounting plate 170 on bearing 48. An annular coupling plate 172 is disposed below plate 170 and also extends below the top wall 168 of casing 164 and is bolted both to the plate and to wall 168.

It will of course be appreciated that the preceding description relates to a specific embodiment of the invention only and that many modifications are possible. For example, as indicated above, the two latching mechanisms need not be positively coupled together by way of a central shaft. Also, the detent balls described in association with the latch members 64, 66 and 68 could be replaced by detent members of other shapes. Where the detents are required to withstand larger forces of than can be accommodated by balls, detent members having angular outer faces may be employed in association with socket members having complimentary faces. Another modification would be to provide the spring biassing in the socket member rather than in the latch member. Also, for light duty applications, it might be possible to use only one detent member for each latch member.

In the illustrated embodiment, the latch members are shown in co-planar relationship with respect to the associated door leaves. While this arrangement is to be preferred it is not essential within the broad scope of the invention. For example, the latch members could be disposed at 90° with respect to the associated leaves and arranged to co-operate with other forms of retaining means inside the housing of the latching mechanism. For example, the ends of the latch members could co-operate with specially provided socket formations projecting upwardly from the top surface of the housing base plate 70. Another possibility which could be employed with this arrangement or with radially disposed latch members would be to provide detent means between the upper surface of the housing base plate 70 and the lower surfaces of the latch members. For example, detent balls could be spring biassed downwardly from the latch members for engagement in complimentary recesses in the upper surface of the housing base plate.

I claim:

1. A collapsible revolving door comprising:

a plurality of door leaves normally extending radially outwardly from a generally vertical axis in angularly spaced positions;

upper and lower bearing means mounting the leaves in a doorway for rotation about said axis; and, upper and lower latching mechanisms interposed between said leaves and the respective bearing means and adapted to normally maintain the leaves in said radial positions but to permit pivotal movement of each leaf about a generally vertical axis disposed adjacent the inner end of the leaf, between said normal radial position and a collapsed position in the event that the leaf is subjected to abnormal forces;

each said latching mechanism comprising:

a housing coupled to the relevant one of said bearing means for rotation about said axis; a plurality of coupling pins each coupling one of said leaves to said housing, each said pin being mounted to turn in the housing about the pivot axis of the associated leaf while being restrained against movement laterally of said leaf pivot axis; a plurality of latch members disposed in said housing and each coupled to one of said coupling pins so that pivotal movement of the leaf between its normal radial position and said collapsed position causes concomitant pivotal movement of the associated latch member; each latch member being coupled at a position generally centrally of its length to the associated coupling pin whereby respective end portions of each latch member are defined on opposite sides of said pin and detent means acting between each said end portion of each latch member and the housing, said detent means being adapted to retain said latch members in said normal positions but to permit release of any latch member in the event that abnormally high forces are applied to the associated leaf so that the leaf can move to its collapsed position.

2. A door as claimed in claim 1, wherein each leaf and the associated latch member are disposed in generally co-planar relationship, and wherein said housing includes inwardly facing surface portions for co-operation with outer ends of the latch member and a reaction member disposed centrally of said housing and having outwardly facing surface portions for co-operation with inner ends of said latch member, and wherein said detent means are spring biassed and are provided between the inner end of each latch member and the associated surface portion of said reaction member and between the outer end of each member and the associated surface portion of said housing, said detent means being adapted to normally retain said latch members in their radial positions and being adapted to release the latch members in the event that said forces applied to any door leaf exceed the spring biassing effect of said detent means.

3. A latching mechanism for use in a collapsible revolving door, the mechanism comprising: a housing adapted to be coupled to bearing means for rotatably supporting the housing about an axis of rotation of the door; a plurality of coupling pins mounted to turn in the housing about pivot axes parallel to said axis of rotation while being restrained against movement laterally of said leaf pivot, said pins each extending into said housing and being adapted to be coupled externally of the housing to a leaf of said door so that the leaf can turn with the pivot pin relative to said housing; a plurality of latch members disposed in said housing and each coupled to one of said coupling pins so that said member is turnable with the pin between a first position corresponding to a normal radial position of a door coupled to said pin in use, and a second position corresponding to a collapsed position of said door, each latch member being coupled at a position generally centrally of its length to the associated coupling pin whereby respective end portions of each latch member are defined on opposite sides of said pin and detent means acting between each said end portion of each latch member and the housing, said detent means being adapted to retain said latch members in said first positions but to permit release of the latch members for movement to said second positions in the event that abnormally high turning forces are applied to said coupling pin.

4. A collapsible revolving door comprising:

a plurality of door leaves normally extending radially outwardly from a generally vertical axis in angularly spaced positions;

upper and lower bearing means mounting the leaves in a doorway for rotation about said axis; and, upper and lower latching mechanisms interposed between said leaves and the respective bearing means and adapted to normally maintain the leaves in said radial positions but to permit pivotal movement of each leaf about a generally vertical axis disposed adjacent the inner end of the leaf, between said normal radial position and a collapsed position in the event that the leaf is subjected to abnormal forces;

each said latching mechanism comprising:

a housing coupled to the relevant one of said bearing means for rotation about said axis; a plurality of pins each coupling one of said leaves to said housing and being mounted to turn in the housing about the pivot axis of the associated leaf; a plurality of latch members disposed in said housing and each coupled at a position intermediate its ends to one of said coupling pins so that pivotal movement of the leaf between its normal radial position and said collapsed position causes concomitant pivotal movement of the associated latch member; and means in said housing retaining said latch members in said normal positions but adapted to permit release of any latch member in the event that abnormally high forces are applied to the associated leaf so that the leaf can move to it collapsed position, wherein each leaf and the associated latch member are disposed in generally co-planar relationship, and wherein said retaining means comprise inwardly facing surface portions of said housing adapted for co-operation with outer ends of the latch member; a reaction member disposed centrally of said housing and having outwardly facing surface portions for co-operation with inner ends of said latch members; and spring biassed detent means provided between the inner end of each latch member and the associated surface portion of said reaction member and between the outer end of each member and the associated surface portion of said housing, said detent means being adapted to normally retain said latch members in their radial positions and being adapted to release the latch members in the event that said forces applied to any door leaf exceed the spring biassing effect of said detent means.

5. A door as claimed in claim 4, wherein said housing comprises a base having an inner surface on which said latch members can pivot, an annular wall extending upwardly from the base about said axis and defining said inwardly facing surface portions, and a central collar defining said reaction member.

6. A door as claimed in claim 5, wherein said detent means comprise a detent ball at each end of each latch member, associated springs biassing said detent balls outwardly of the associated members; and a corresponding socket member for co-operation with each ball, each socket member being carried by the relevant one of said surface portions of said housing and reaction member and having a recessed face for receiving said detent ball.

7. A door as claimed in claim 6, wherein each said latch member comprises a main body portion of elongate shape having a transverse bore at the centre of its length receiving the associated coupling pin and in which said pin is fixed against turning, said body portion further including two lateral bores opening to respective ends of said portion and receiving said springs and balls; and end caps fixed at respectively opposite ends of said body portion and retaining said detent ball against the biassing effect of said springs, said caps being apertured to permit the detent balls to project outwardly from said latch members.

8. A door as claimed in claim 4, further comprising a central shaft disposed on said generally vertical axis and from which said leaves normally extend radially outwardly, said shaft being positively coupled to the housings of both of said upper and lower latching mechanisms whereby said mechanisms rotate in synchronism and the corresponding latch members of the respective mechanisms will operate in unison.

9. A door as claimed in claim 8, wherein said central shaft is made in two axially aligned parts releasably coupled together so as to permit installation and removal of the shaft while the latching mechanisms are in place.

10. A door as claimed in claim 4, wherein three of said door leaves are provided and are disposed in equiangularly spaced positions about said axis, wherein three associated latch members are provided in said housing of each latching mechanism, and wherein each of said reaction members in the respective housings is of generally triangular shape and has three generally flat faces defining said surface portions of the reaction member.

11. A door as claimed in claim 3, wherein each said housing further comprises a cover plate secured to said annular wall generally parallel to said base and defining with said base a space receiving said latch members, and wherein said cover plate includes an integral collar portion which projects outwardly of the housing and co-operates with an inner bearing race of the relevant one of said bearing means.

* * * * *